US010575607B2

(12) United States Patent
Bullard

(10) Patent No.: US 10,575,607 B2
(45) Date of Patent: Mar. 3, 2020

(54) SHOCK ABSORBING WALKING CANE

(71) Applicant: Chuck Bullard, North Miami, FL (US)

(72) Inventor: Chuck Bullard, North Miami, FL (US)

( * ) Notice: Subject to any disclaimer, the term of this patent is extended or adjusted under 35 U.S.C. 154(b) by 0 days.

(21) Appl. No.: 16/156,980

(22) Filed: Oct. 10, 2018

(65) Prior Publication Data

US 2019/0104814 A1 Apr. 11, 2019

Related U.S. Application Data

(60) Provisional application No. 62/570,272, filed on Oct. 10, 2017.

(51) Int. Cl.

| | |
|---|---|
| ***A45B 9/00*** | (2006.01) |
| ***A45B 3/02*** | (2006.01) |
| ***A45B 9/04*** | (2006.01) |
| ***A45B 3/00*** | (2006.01) |
| ***A45B 9/02*** | (2006.01) |

(52) U.S. Cl.

CPC ..... *A45B 9/00* (2013.01); *A45B 3/00* (2013.01); *A45B 3/02* (2013.01); *A45B 9/02* (2013.01); *A45B 9/04* (2013.01); *A45B 2009/007* (2013.01)

(58) Field of Classification Search

CPC .... A45B 3/00; A45B 3/04; A45B 9/00; A45B 2009/005; A61H 3/0288

See application file for complete search history.

(56) References Cited

U.S. PATENT DOCUMENTS

| | | | | |
|---|---|---|---|---|
| 2,802,479 A * | 8/1957 | Hickman | ..... | A45B 9/00 135/65 |
| 5,197,501 A * | 3/1993 | Ragatz | ..... | A45B 3/00 135/66 |
| 6,595,226 B2 * | 7/2003 | Uemura | ..... | A45B 9/00 135/69 |
| 8,397,737 B2 * | 3/2013 | Evans | ..... | A45B 9/00 135/65 |
| 2010/0313925 A1 * | 12/2010 | Jiang | ..... | A45B 9/04 135/82 |

FOREIGN PATENT DOCUMENTS

| | | | | |
|---|---|---|---|---|
| FR | 2617023 A1 * | 12/1988 | ..... | A45B 9/00 |
| WO | WO-03034859 A1 * | 5/2003 | | |

* cited by examiner

*Primary Examiner* — Noah Chandler Hawk
(74) *Attorney, Agent, or Firm* — David W. Barman

(57) ABSTRACT

A walking cane is provided having a foot, a handle, a pole member having a hollow interior cavity or shaft connecting said foot with said handle, an adjustable spring contained within said hollow shaft, and a tension adjusting mechanism operatively associated with said adjustable spring constructed and arranged to adjust spring tension imparted when downward force is applied from said handle, through said shaft and terminating at said foot.

8 Claims, 14 Drawing Sheets

SHOCK ABSORBING WALKING CANE

INDEX TO RELATED APPLICATIONS

This application is a non-provisional of and claims benefit to U.S. provisional patent application Ser. No. 62/570,272 filed Oct. 10, 2017 the disclosure of which is incorporated herein by reference in its entirety.

BACKGROUND OF THE INVENTION

The walking cane has its origins going back at least until the 17th century. The foot was often protected with something such as metal in order to fend off mud dirt and other debris on the roads, and of that time period. Handles were often decorative. However, these canes were merely an accessory and not necessarily for persons needing assistance while walking. It was not until the late 19th and early 20th century the persons realized these accessories can assist persons having walking and/or mobility issues.

While there are many canes available today to help with these persons having walking and/or mobility issues, there are still shortcomings in their configurations.

The present invention addresses many of these shortcomings.

SUMMARY OF THE INVENTION

The present invention provides for an adjustable tension shock absorbing spring-loaded walking cane. This configuration allows for a mass-produced item to be user customizable and compensate for many difficulties associated with mobility issues.

In one embodiment, the adjustable tension, shock absorbing, spring loaded walking cane is configured to significantly decrease the amount of shock and tension to the hand, wrist, shoulders back and neck.

The adjustable tension feature gives each user the ability to adjust tension for maximum comfort depending on their own weight and height.

The built-in shock absorbent feature causes a reduction in the possibility of damage and pain to the joints and a significant increase in comfort that aids in the healing process for injured or sick.

In one embodiment, incorporated therewith the walking cane of the present invention is an led light and an alarm for emergencies.

In one embodiment, the cane has a shock absorption mechanism using a compression spring to reduce shock upon impact.

In one embodiment, the cane has height adjustability via compression assembly.

In one embodiment, the cane has changeable handles.

In one embodiment, the cane has changeable feet.

In one embodiment, the cane has alarm for emergency situations.

In one embodiment, the cane is self-adjusting shock absorbing mechanism is formed within and applied to crutches In one embodiment the present invention is a walking cane comprising:

- a foot;
- a handle;
- at least one pole member having an internal cavity or internal shaft connecting said foot with said handle;
- an adjustable spring contained within said shaft; and

- a tension adjusting mechanism operatively associated with said adjustable spring constructed and arranged to adjust spring tension imparted when downward force is applied from said handle, through said pole member and shaft and terminating at said foot.

In one embodiment the present invention, the handle is permanently attached to the shaft.

In one embodiment the present invention, the handle is removably attached to the shaft.

In one embodiment the present invention, the foot is permanently attached to said shaft.

In one embodiment the present invention, the foot is removably attached to said shaft. One embodiment utilizes magnets to selectively remove and change the foot member as desired.

In one embodiment the present invention, the adjustable spring is removably positioned said shaft.

In one embodiment the present invention, the tension adjusting mechanism is a mechanism-engaging wheel that rotates about said pole member of said cane, wherein said wheel configured to engage interior teeth of a tension plunging rod that subsequently engages a tension plunging rod configured to urge said tension plunging rod in the downward direction, to compress said compression spring.

In one embodiment the present invention, the system further comprises at least one light.

In one embodiment the present invention, the system further comprising an audio alert system.

In one embodiment the present invention is a walking cane consisting essentially of:

- a foot;
- a handle;
- at least one pole member having an internal cavity or internal shaft connecting said foot with said handle;
- an adjustable spring contained within said shaft; and
- a tension adjusting mechanism operatively associated with said adjustable spring constructed and arranged to adjust spring tension imparted when downward force is applied from said handle, through said pole member and shaft and terminating at said foot;
- a light;
- an audio alarm;
- a pair of magnets constructed and arranged for removing the foot and replacing with a user selected foot.

DETAILED DESCRIPTION OF THE PREFERRED EMBODIMENT

Figure 1:
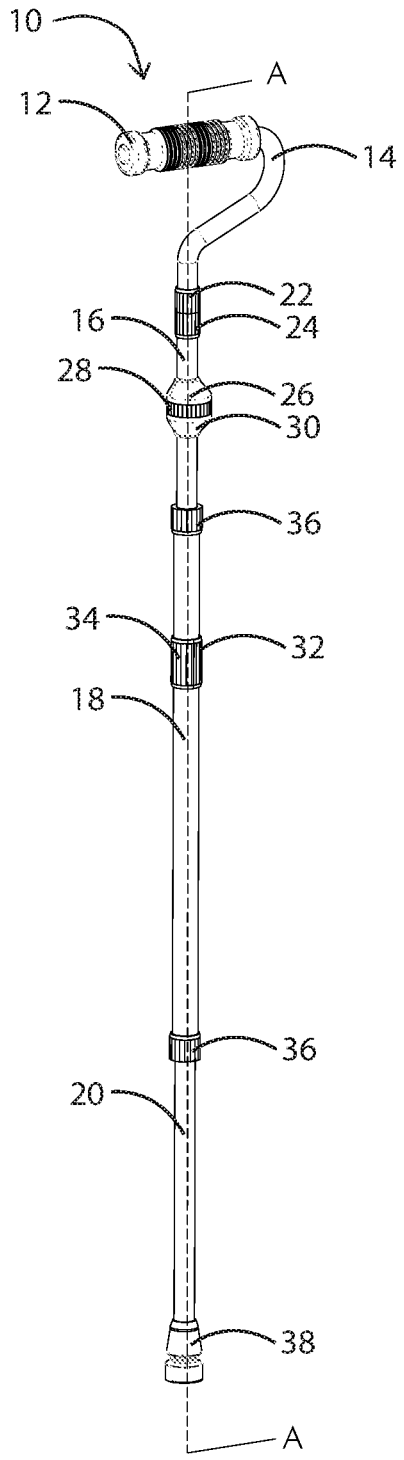
FIG. 1 is a side perspective view according to one bottom of the present invention.

The present invention, as disclosed herein, and demonstrated through certain embodiments presented on the accompanying drawing sheets relates to improvements in a walking cane.

A walking cane, as is generally understood has a foot portion that contacts the ground or other walking surface, an upward projecting shaft, and a handle.

Assembly 10 has handle 12 on a first or upper end and foot 38 on a second or lower end. Handle 12 is supported by base tube 14 that is affixed to first pole member 16 utilizing a threaded handle male coupling 22 constructed and arranged to attached to threaded female coupling 24. Gear assembly 101 is user adjustable utilizing engaging wheel 28 that is positioned between upper engaging will housing 26 and lower engage in real housing 30. Rotational movement of engaging wheel 28 serves to adjust tension on compression spring 64. Locking coupling 34 is constructed and arranged to meet with locking coupling 32 in order to fix first pole member 16 into position. Extending downward from each of locking coupling 32 and locking coupling 34 is second pole member 18. Compression coupling 36 is on the lower end of second pole member 18 and connects second pole member 18 to 3rd or lower pole member 20. The bottom end of assembly 10 has foot 38. In one embodiment, foot 38 is a removable foot and or foot assembly.

Figure 2:
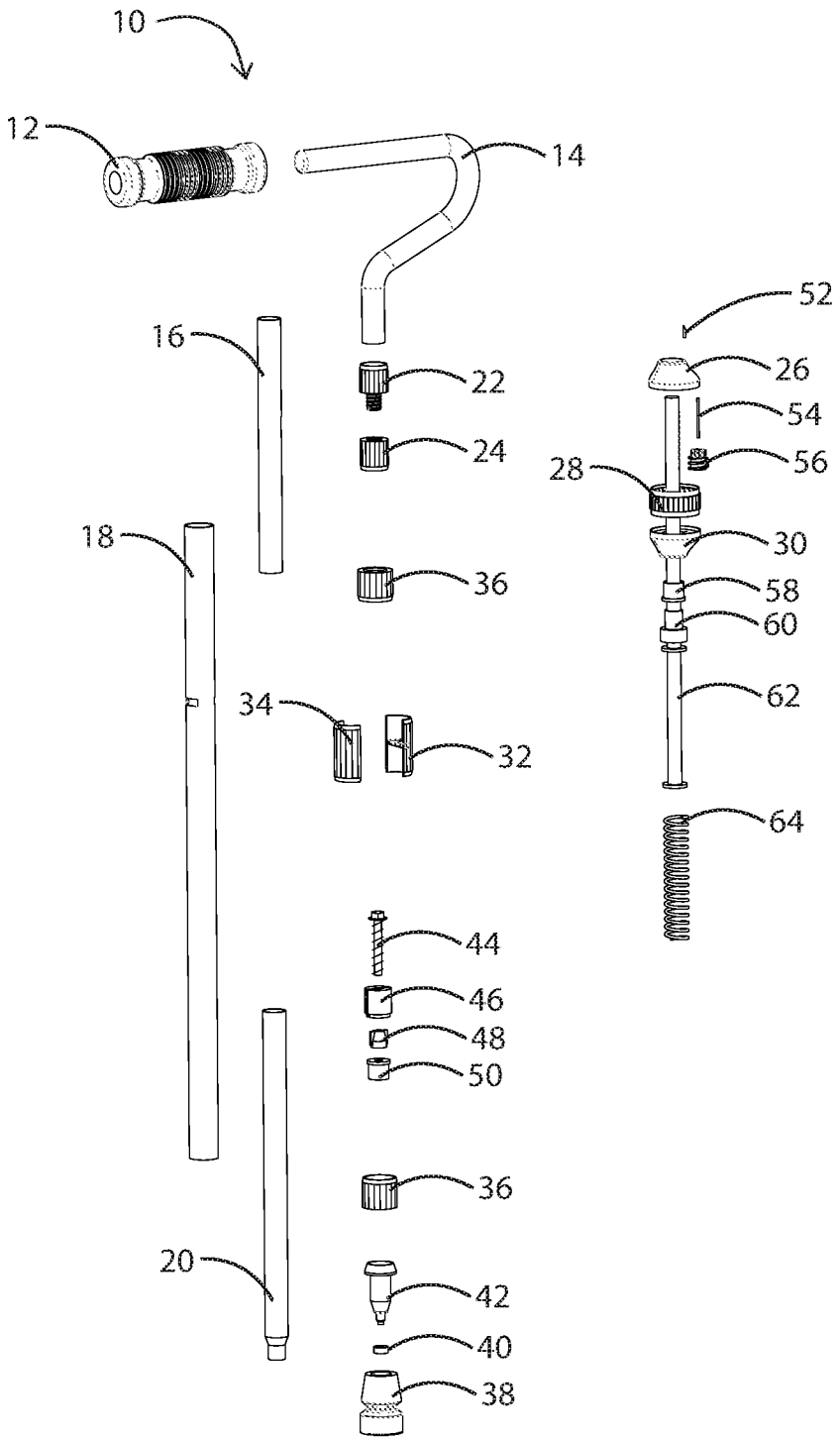
FIG. 2 is an exploded view of component parts according to one bottom of the present invention.
Figure 3:
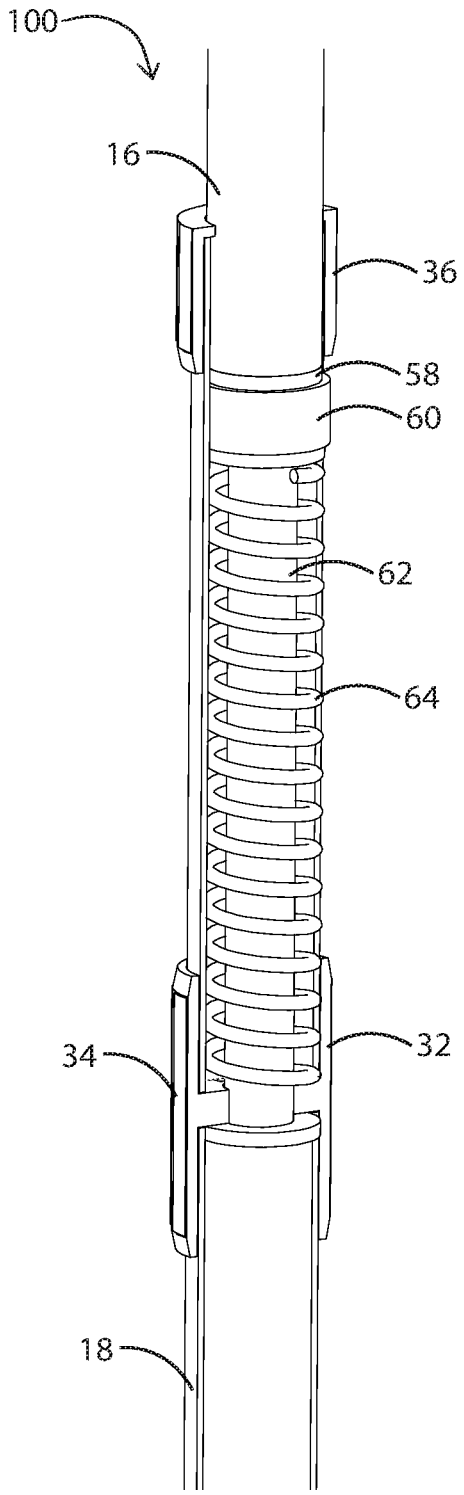
FIG. 3 is a side partial cross-section view along section lines A-A of FIG. 1 of the spring assembly according to one embodiment of the present invention.
Figure 4:
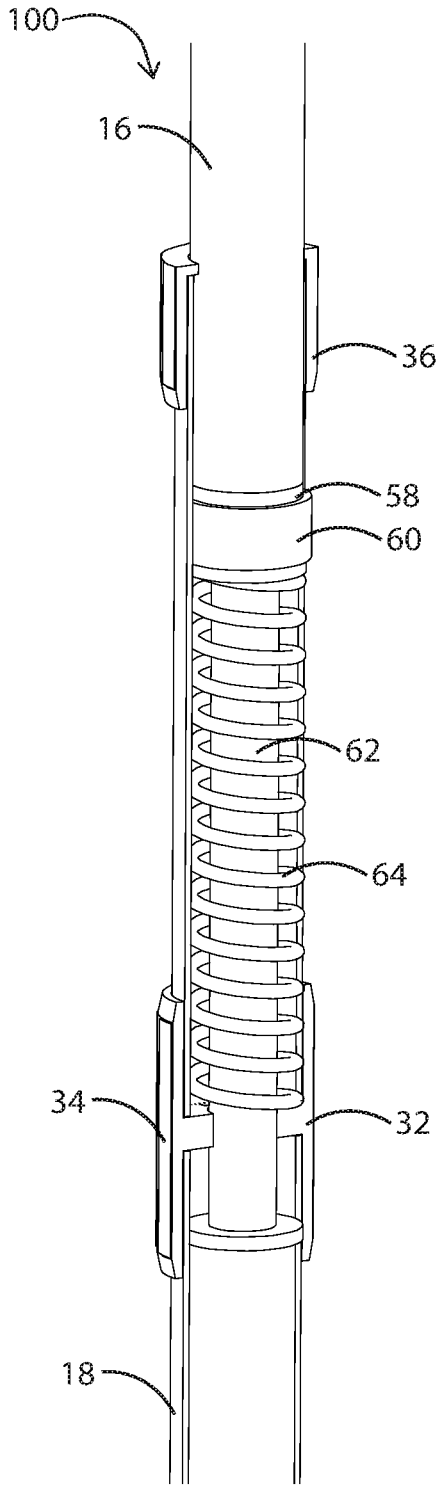
FIG. 4 is a side partial cross-section view along section lines A-A of FIG. 1 of the spring assembly according to one embodiment of the present invention.
Figure 5:
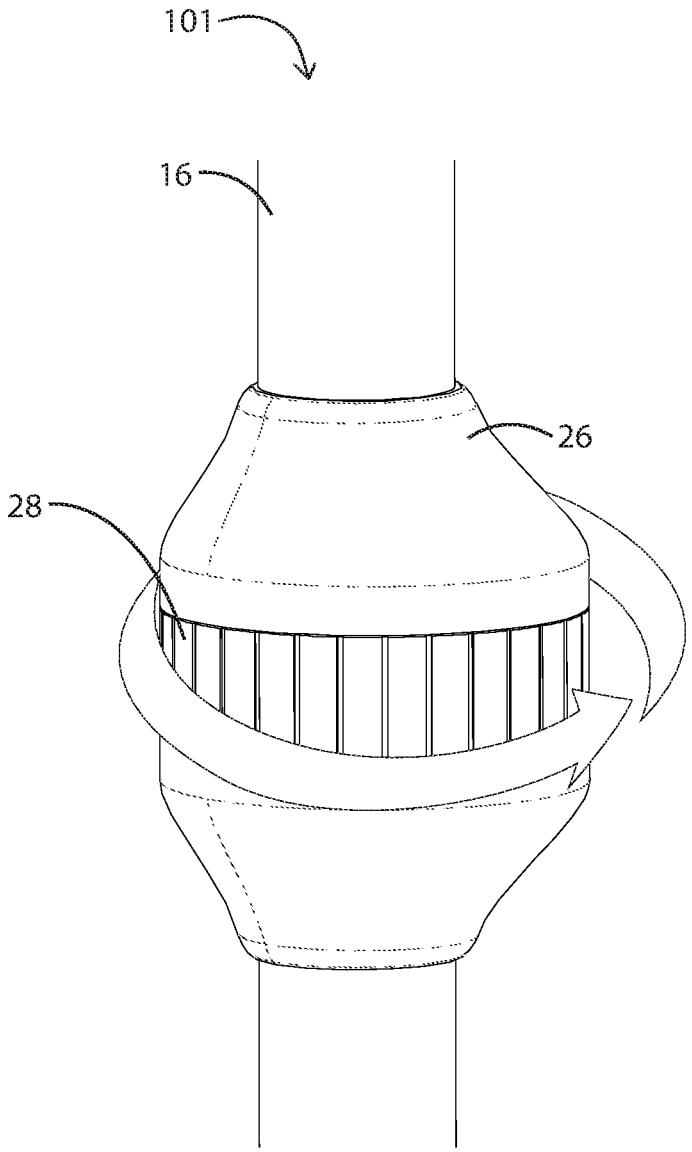
FIG. 5 is a side partial view of a gear assembly according to one bottom of the present invention.
Figure 6:
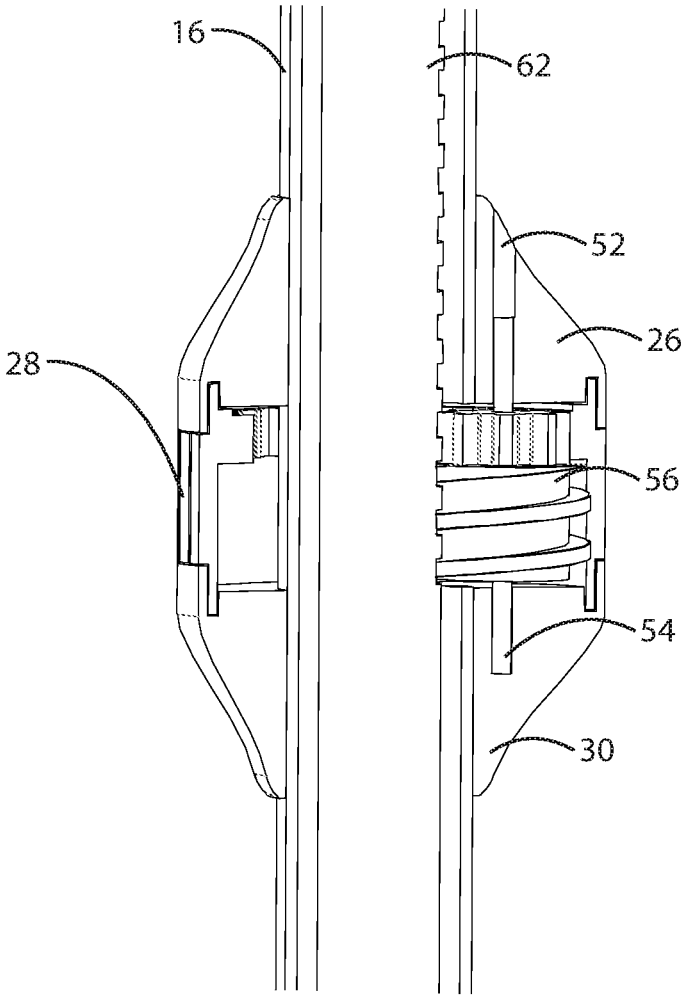
FIG. 6 is a side partial cross-sectional view along section lines A-A of FIG. 1 of the gear assembly according to one bottom of the present invention.
Figure 7:
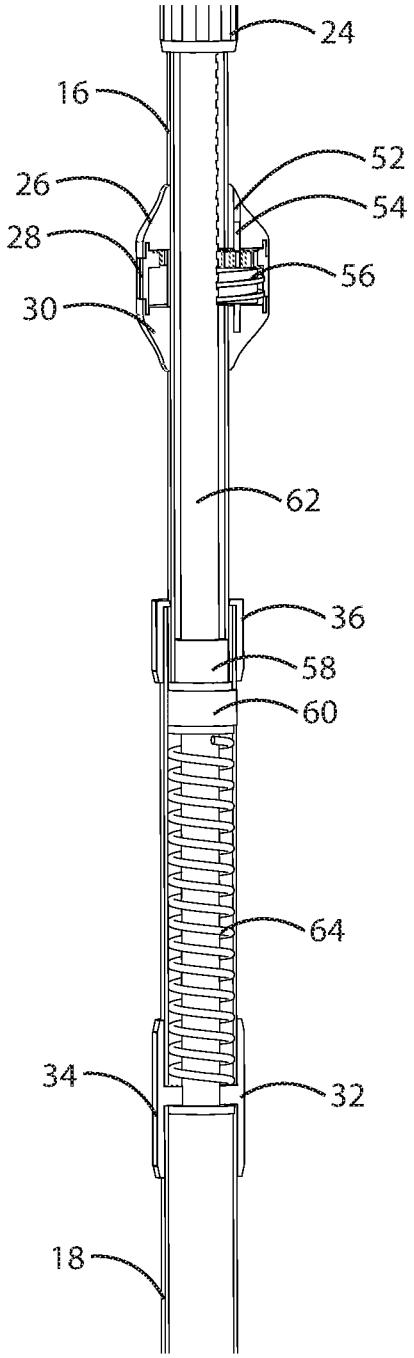
FIG. 7 is a side partial cross-sectional view along section lines A-A of FIG. 1 of the spring assembly and gear assembly according to one body to the present invention.
Figure 8:
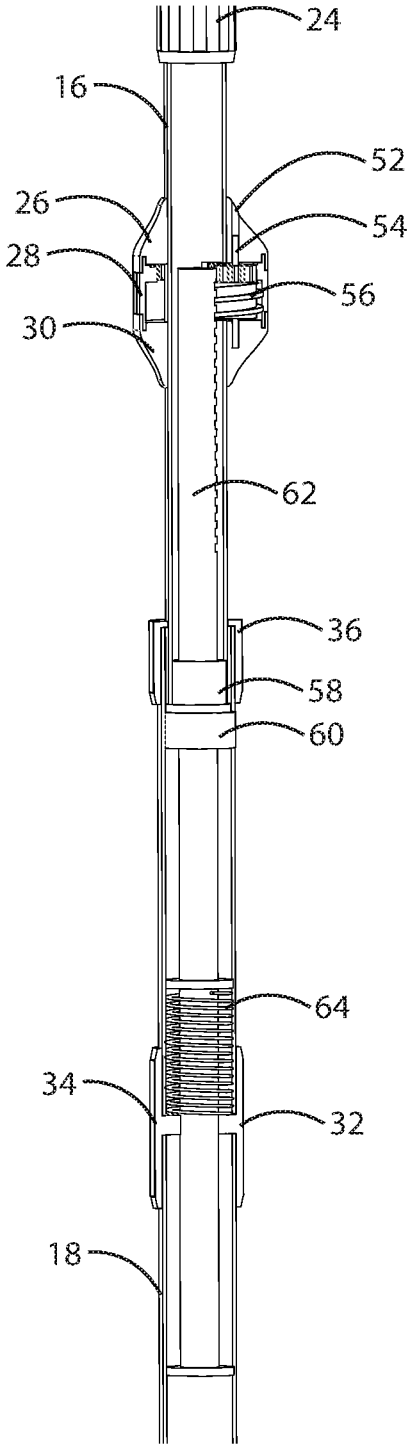
FIG. 8 is a side partial cross-sectional view along section lines A-A of FIG. 1 demonstrating tension upon the spring assembly.
Figure 9:
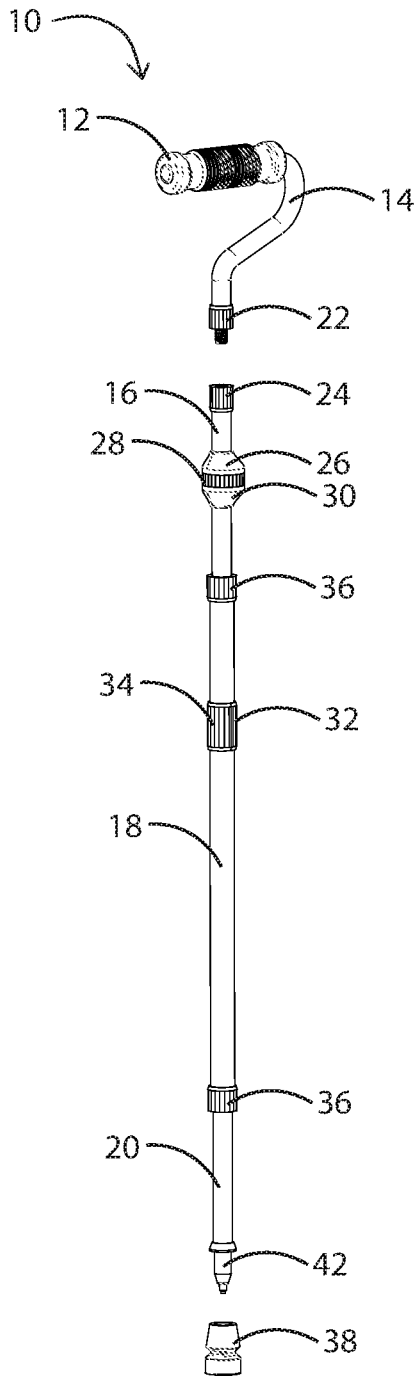
FIG. 9 is a side perspective view of separated components according to one bottom of the present invention.
Figure 10:
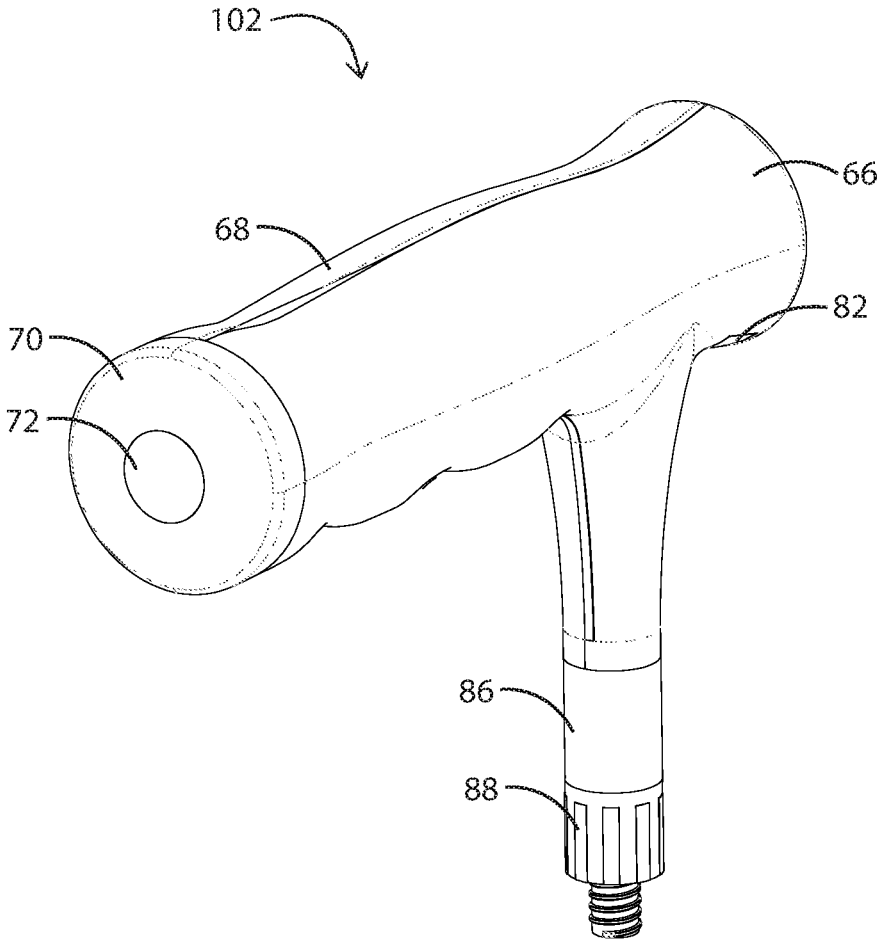
FIG. 10 is a side perspective view of a handle assembly according to one about them in the present invention.
Figure 11:
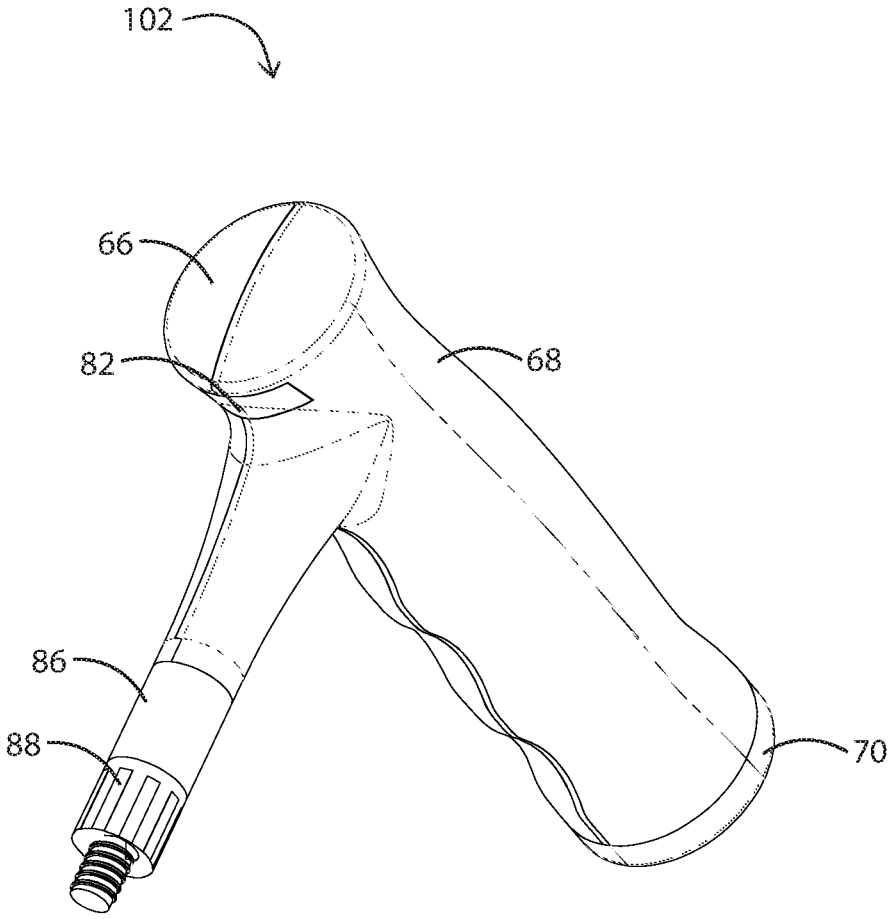
FIG. 11 is a bottom perspective view of a handle assembly according to one bottom of the present invention.
Figure 12:
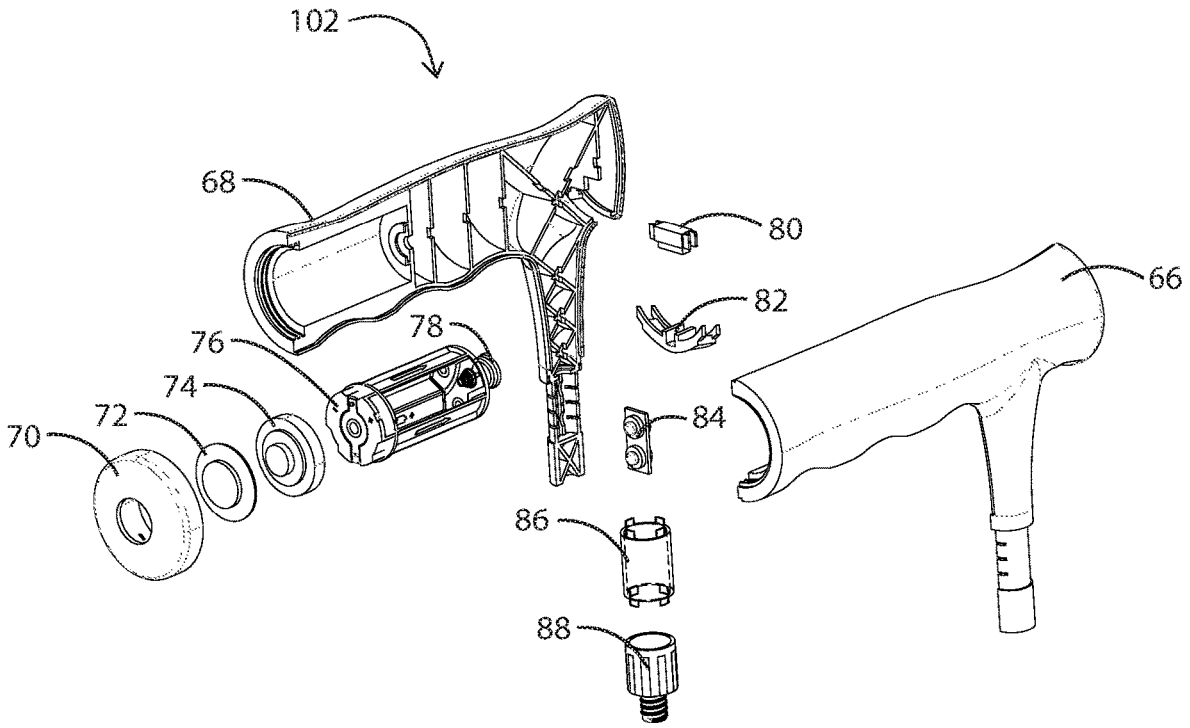
FIG. 12 is an exploded view of component parts of a handle assembly according to one about them and of the present invention.

As demonstrated in FIG. 2, various component parts providing for assembly 10 include and interior foot magnet 40 positioned within removable foot 38. Above foot magnet 40 is terrain tip 42 that preferably is constructed of magnetic materials in order to provide magnetic connection with magnet 40. Compression coupling 36 includes compression assembly 44 compression assembly fitting sleeve 46 compression assembly fitting spacer 48 and compression assembling fitting tube 50 positioned within an interior cavity of compression coupling 36.

Axis plug 52 is positioned above engaging wheel 28 that further includes gear axis 54 gear mechanism 56 tube compression fitting 58 compression retaining fitting 60 and tension plunging rod 62. As generally understood, rotational movement of engaging wheel 28 imparts motion on gear mechanism 56 that will move tension plunging rod 62 along the substantial vertical axis of assembly 10 to either compress or decompress compression spring 64 as desired by the user.

Figure 13:
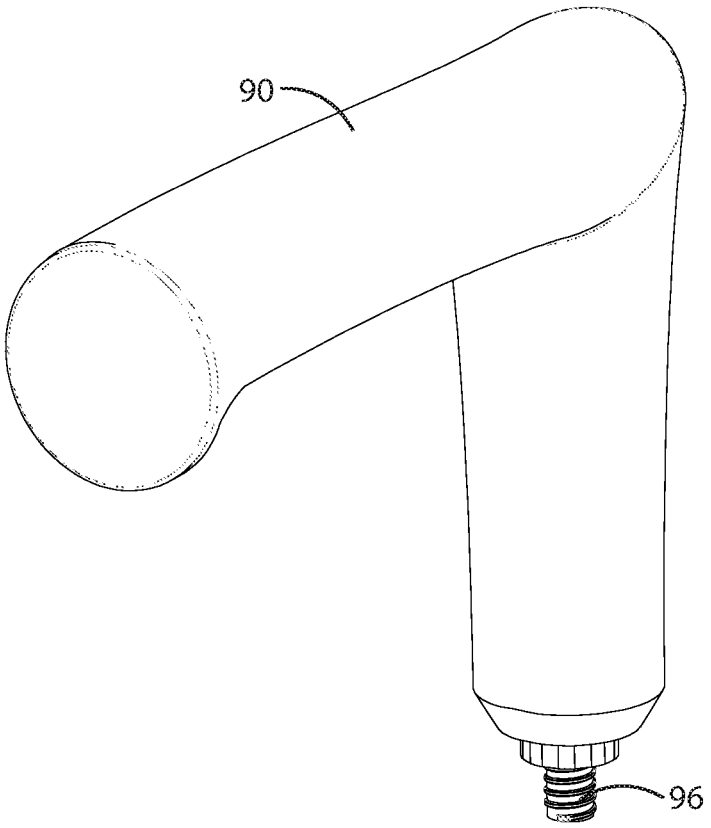
FIG. 13 is a side perspective view of a threaded handle assembly according to one vitamin of the present invention.

In one embodiment, handle assembly 102 includes a first handle shell 66 and second handle shell 68 having an end cap 70 constructed and arranged with actuator 72 accessible by a user. Actuator 72 will engage power button 74*o* that is operatively associated with electronic components controlled by battery cradle 76. Conducting spring 78 further provides power and operation to alarm alert 80 that is positioned with alert button cover 82 on handle assembly 102. In one embodiment, handle assembly 102 further includes light 84 that is held in position by coupling 86 dependent on and position within light lens 88. Light lens 88 is formed of substantially transparent or translucent material such that light emitted from light 84 is visible outside light lens 88. Handle assembly 102 further has coupling 86 connecting assembly 10 to light lens 88. In one embodiment, a handle assembly is provided as demonstrated in FIG. 13 with a mail threaded screw member for attachment to the system of the invention.

In one embodiment the cane is constructed to receive male screw 96 for attaching handle.

Figure 14:
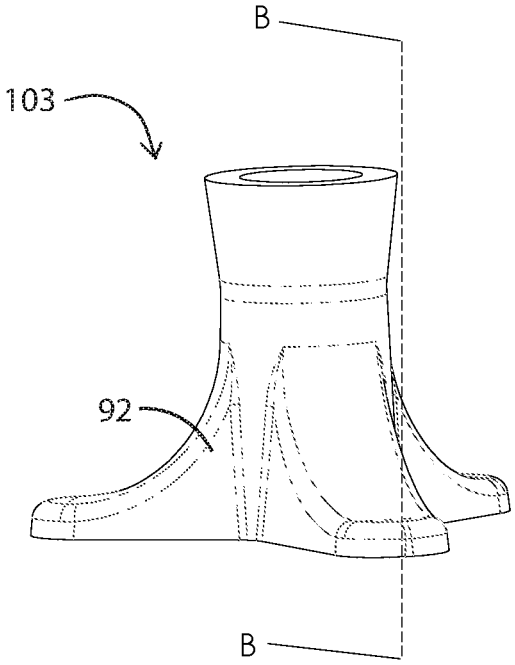
FIG. 14 is a side perspective view of a foot assembly according 20 bottom of the present invention.
Figure 15:
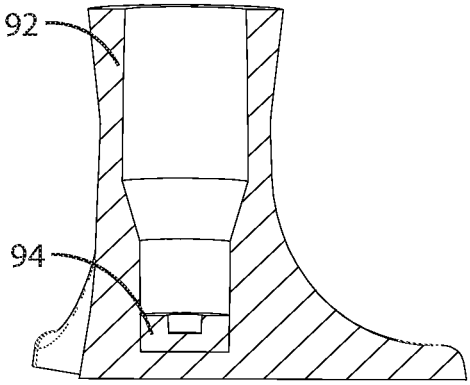
FIG. 15 is a side cross-section view along sectional lines B-B from FIG. 14 of a foot assembly according to one about them in the present invention.

In one embodiment, as demonstrated in FIGS. 14 and 15 spread foot assembly 103 is formed of spread foot members 92 and includes magnet 94 positioned therein.

In one embodiment of the present invention, contained within the shaft of the walking cane is a compression spring. The compression spring, according to one embodiment of the present invention, is constructed and arranged with a user accessible tension adjustment mechanism. In providing a cane with a user adjustable tension mechanism for the compression spring, the cane is customizable and more easily used taking into account such aspects as the height, weight, dexterity, and stability, of the person using the cane of the present invention.

Although various components are demonstrated in the accompanying figures, they are provided by way of example and are not meant to limit the adjustable tension feature of the present invention.

In the embodiment demonstrated in the accompanying figures, the adjustable tension mechanism includes a mechanism-engaging wheel that rotates about the shaft of the cane the present invention. The rotation of the wheel in a particular direction will engage interior teeth of a tension plunging rod. Engaging the tension plunging rod will urge the rod in the downward direction, that is to say towards the foot of the cane, to compress the compression spring.

In one embodiment of the present invention, the cane is presented with various electronic components. These components can include anyone or any combination of an emergency alert button that will actuate an audible signal to alert persons within audible sound range to hear that an alarm has been sounded. In another embodiment, electronic components further include actuation of a wireless transmission to alert that an emergency or urgent situation is occurring. The wireless transmission can include any one of a text message, an SMS message, and alert to a monitoring system, and combinations thereof. In another embodiment of the present invention, there is an actuator to turn on and off a light incorporated with the cane of the present invention. In one embodiment of the present invention either or both of the handle and foot of the cane the present invention are removable and replaceable as desired. This will account for user customization to various handles and feet according to the preference of a user.

In one embodiment, the interior spring is removable and replaceable in order that particular tensions and tension ranges are selected and utilized according to the present invention.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A walking cane comprising:

a foot;

a handle;

at least one pole member having an internal cavity, said internal cavity defining a shaft, said pole member connecting said foot with said handle;

an adjustable spring contained within said shaft; and a tension adjusting mechanism operatively associated with said adjustable spring constructed and arranged to adjust spring tension imparted when downward force is applied from said handle, through said pole member and shaft and terminating at said foot, wherein said tension adjusting mechanism is a mechanism-engaging wheel that rotates about said pole member of said cane, wherein said wheel is configured to engage interior teeth of a gear mechanism, and wherein rotational movement of said wheel imparts motion on the gear mechanism, the gear mechanism subsequently moving tension plunging rod in the downward direction to compress said compression spring.

2. The cane of claim 1 wherein said handle is permanently attached to said shaft.

3. The cane of claim 1 wherein said handle is removably attached to said shaft.

4. The cane of claim 1 wherein said foot is permanently attached to said shaft.

5. The cane of claim 1 wherein said foot is removably attached to said shaft.

6. The cane of claim 1 wherein said adjustable spring is removably positioned said shaft.

7. The cane of claim 1 further comprising at least one light.

8. The cane of claim 1 further comprising an audio alert system.

* * * * *